US006579332B1

(12) United States Patent
Takemura et al.

(10) Patent No.: US 6,579,332 B1
(45) Date of Patent: Jun. 17, 2003

(54) METAL-BONDED GRINDING TOOL AND MANUFACTURING METHOD THEREFOR

(75) Inventors: Sokichi Takemura, Shizuoka (JP); Tadao Ishikawa, Mobara (JP)

(73) Assignee: Tenryu Seikyo Kabushiki Kaisha, Shizuoka (JP)

( * ) Notice: Subject to any disclaimer, the term of this patent is extended or adjusted under 35 U.S.C. 154(b) by 126 days.

(21) Appl. No.: 09/612,294

(22) Filed: Jul. 7, 2000

(30) Foreign Application Priority Data

Jul. 9, 1999 (JP) ..... 11-196637

(51) Int. Cl.[7] ..... B24D 18/00

(52) U.S. Cl. ..... 51/309; 51/305; 51/298; 51/307; 51/293

(58) Field of Search ..... 51/295, 305, 298, 51/307, 309, 293

(56) References Cited

U.S. PATENT DOCUMENTS 5,492,771 A * 2/1996 Lowder et al. ..... 428/546
5,855,314 A * 1/1999 Shiue et al. ..... 228/124.5
6,187,071 B1 * 2/2001 Andrews et al. ..... 228/122.1
6,245,443 B1 * 6/2001 Shiue et al. ..... 428/332

FOREIGN PATENT DOCUMENTS

JP 09-057631 3/1997
JP 11-165261 6/1999

OTHER PUBLICATIONS

Perry, "Chemical Engineers' Handbook", pp. 19–14 to 19–17, McGraw Hill, Inc., 1973 (no month).*

* cited by examiner

*Primary Examiner*—Michael Marcheschi
(74) *Attorney, Agent, or Firm*—Arent Fox Kintner Plotkin & Kahn PLLC

(57) ABSTRACT

A metal-bonded grinding tool including a base, and abrasive grains bonded to the base by a bond matrix containing Cu alloy as a main component. The bond matrix further contains a powder selected from the group consisting of Ti, Al, and a mixture thereof. An average grain protrusion is set to 30% or more of an average grain diameter, and an average grain spacing is set to 200% or more of the average grain diameter.

2 Claims, 5 Drawing Sheets

METAL-BONDED GRINDING TOOL AND MANUFACTURING METHOD THEREFOR

BACKGROUND OF THE INVENTION

1. Field of the Invention

The present invention relates to a metal-bonded grinding tool having abrasive grains fixed by metal, and also to a manufacturing method for such a metal-bonded grinding tool.

2. Description of the Related Art

A conventional metal-bonded grinding tool is manufactured by mixing abrasive grains with metal powder, next forming the mixture into a given shape, and finally sintering the formed mixture integrally with a base or body of the tool to thereby fix the abrasive grains to the base (impregnated sintered tool). As another manufacturing method for a conventional metal-bonded grinding tool, abrasive grains are first placed on a base or body of the tool, and nickel plating (electrically or chemically) is applied so as to cover the abrasive grains with nickel metal deposited, thereby mechanically fixing the abrasive grains through the deposited nickel metal to the base.

In these conventional metal-bonded grinding tools, the abrasive grains are simply mechanically fixed to the metal bond matrix, and there is a limit in force of retaining the abrasive grains by the metal bond matrix. Accordingly, there is a possibility that the abrasive grains may be separated from the metal bond matrix in a relatively short period of time. Furthermore, since the amount of projection of each abrasive grain is small, the exposed surface of the metal bond matrix comes into contact with a workpiece. Accordingly, contact resistance and erosion wear tend to occur on the exposed surface of the metal bond matrix, causing a problem that the grinding tool is lacking in grinding ability and durability.

Japanese Patent Laid-open No. Sho 63-251170 discloses a cutting tool manufactured by fixing abrasive grains through nickel plating, and next covering the nickel plating with a material having a strength larger than that of the metal bond matrix, so as to retard the separation of the abrasive grains in use of the tool. This covering layer is formed by plasma spraying of metal, carbide, oxide, nitride, etc. However, the formation of the covering layer by plasma spraying may give rise to undue covering of the surface of the abrasive grains with the covering layer. It is therefore necessary to perform a finishing step of removing the covering layer formed on the surface of the abrasive grains by dressing or the like. Further, also in this grinding tool described in this publication, the abrasive grains are simply mechanically fixed by the nickel plating, so that it is difficult to obtain a sufficient force of retaining the abrasive grains to prevent the separation of the abrasive grains.

The metal bond matrix incurs erosion wear due to the contact with a workpiece to expose the abrasive grains. However, in the conventional grinding tools, no chemical bond is present between the metal bond matrix and the abrasive grains, and the abrasive grains are therefore easily separated from the metal bond matrix. Accordingly, the effective use efficiency of the abrasive grains is quite low, the grinding is unstable, and the life of the tool is quite short.

Further, a metal-bonded grinding tool in general has a self-dressing property by the chips of a workpiece to expose the abrasive grains from the surface of the metal bond matrix. Accordingly, the grinding performance is remarkably reduced according to the combination of the workpiece and the metal bond matrix. The amount and shape of the chips may vary according to working conditions, so that the grinding performance may vary according to the matching between the property of the workpiece, the property of the metal bond matrix, and the working conditions.

SUMMARY OF THE INVENTION

It is therefore an object of the present invention to provide a metal-bonded grinding tool and a manufacturing method therefor which can ensure a long life and a high grinding performance by strongly retaining the abrasive grains by the metal bond matrix independently of the property of the workpiece.

It is another object of the present invention to provide a metal-bonded grinding tool and a manufacturing method therefor which can prevent the separation of the abrasive grains from the metal bond matrix and can prevent variations.in the grinding performance during a long period of time.

In accordance with an aspect of the present invention, there is provided a metal-bonded grinding tool comprising a base; and abrasive grains bonded to the base by a bond matrix containing Cu alloy as a main component; the bond matrix further containing a material selected from the group consisting of Ti, Al, and a mixture thereof; an average grain protrusion being set to 30% or more of an average grain diameter, wherein the distance from the surface of a deepest portion of the bond matrix between any adjacent ones of the abrasive grains to the peak of any one of the abrasive grains is defined as a grain protrusion; an average grain spacing being set to 200% or more of the average grain diameter.

Preferably, the Cu alloy is selected from the group consisting of bronze containing 10 to 33 wt % of Sn, brass containing 5 to 20 wt % of Zn, and aluminum bronze containing 5 to 20 wt % of Al. More preferably, the Cu alloy is composed of a plurality of different Cu alloys having the same main ingredient. The abrasive grains are selected from the group consisting of diamond, CBN (cubic boron nitride), SiC (silicon carbide), and cemented carbides powder.

According to the metal-bonded grinding tool of the present invention, the amount of projection of the abrasive grains from the metal bond matrix can be set very large. Accordingly, the removability of the chips of a workpiece from the tool can be improved, and the grinding resistance can be reduced because of no contact between the metal bond matrix and the workpiece. As a result, high grindability can be exhibited and good dissipation of grinding heat can also be ensured.

In accordance with another aspect of the present invention, there is provided a manufacturing method for a metal-bonded grinding tool, comprising the steps of kneading a Cu alloy powder selected from the group consisting of bronze containing 10 to 33 wt % of Sn, brass containing 5 to 20 wt % of Zn, and aluminum bronze containing 5 to 20 wt % of Al, a powder selected from the group consisting of Ti, Ti compound, Al, Al compound, and a mixture thereof, and an organic viscous material to obtain a paste mixture; applying the paste mixture to a base; depositing a given amount of abrasive grains to the paste mixture; heating the paste mixture to a given temperature in a high vacuum of 20 Pa or less to melt at least a part of the paste mixture; and cooling the paste mixture to solidify the at least a part melted, thereby bonding the abrasive grains to the base.

Preferably, the organic viscous material is selected from the group consisting of stearic acid, paraffin, and polyethylene glycol.

According to the manufacturing method of the present invention, chemical bonds are formed between the metal bond matrix and the abrasive grains, because Ti, Ti compound, Al, or Al compound has a reducing power to wet the abrasive grains. Accordingly, the abrasive grains can be strongly bonded to the metal bond matrix, thereby preventing the separation of the abrasive grains from the metal bond matrix.

Further, according to the manufacturing method of the present invention, the abrasive grains are scattered to be deposited on the paste mixture, so that the spacing between the abrasive grains can be freely adjusted. Accordingly, the present invention can be applied to a wide variety of work ranging from a hard material such as stone to a soft material that is prone to cause loading or clogging, such as wood cement board or FRP containing iron.

The above and other objects, features and advantages of the present invention and the manner of realizing them will become more apparent, and the invention itself will best be understood from a study of the following description and with reference to the attached drawings should some preferred embodiments of the invention.

DETAILED DESCRIPTION OF THE PREFERRED EMBODIMENTS

Figure 1:
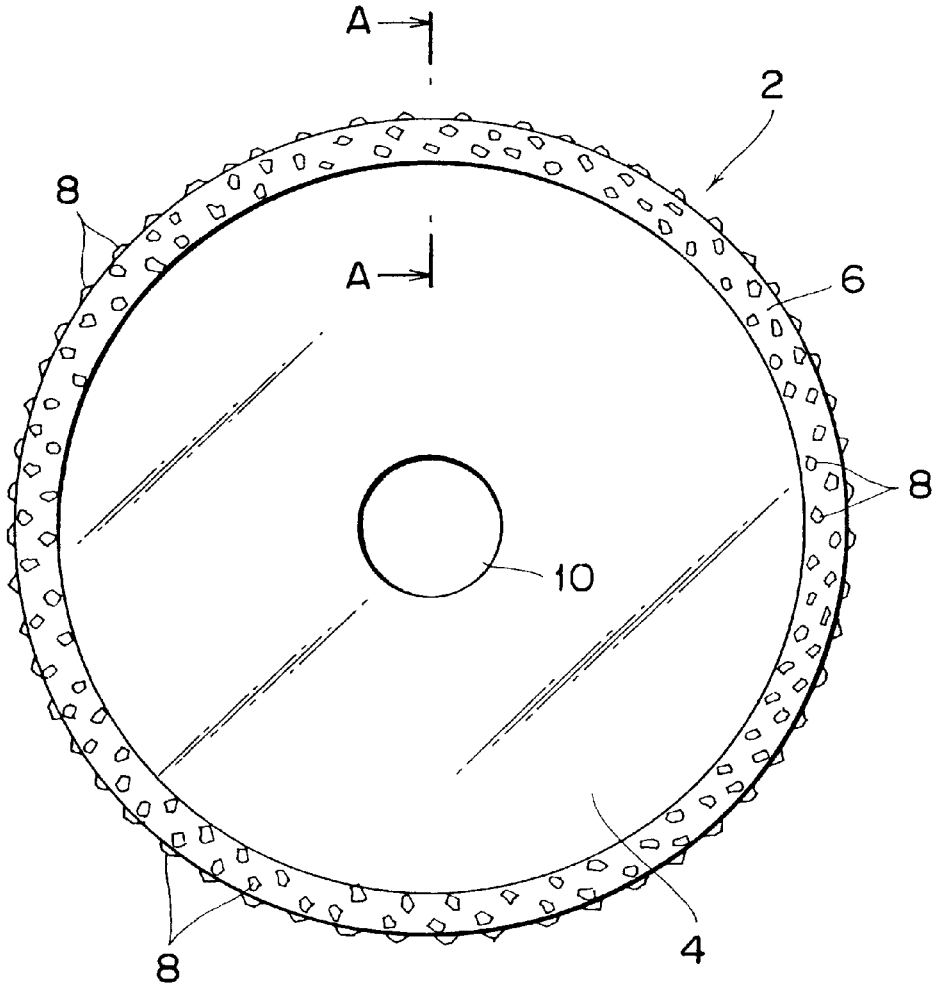
FIG. 1 is a side view of a grinding tool according to a first preferred embodiment of the present invention.
Figure 2:
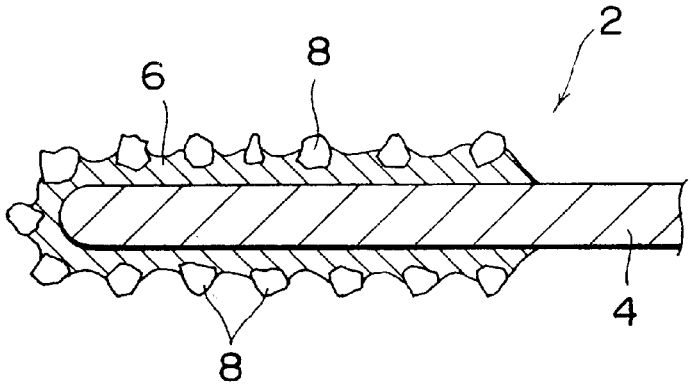
FIG. 2 is a cross section taken along the line A—A in FIG. 1.

Referring to FIG. 1, there is shown a side view of a disk-shaped grinding tool 2 according to a first preferred embodiment of the present invention. FIG. 2 is a cross section taken along the line A—A in FIG. 1. Reference numeral 4 denotes a base or body of the disk-shaped grinding tool 2. The base 4 has a central mounting hole 10 adapted to be fitted with a shaft of a grinding machine. As best shown in FIG. 2, numerous diamond abrasive grains 8 are bonded to be fixed to an outer circumferential portion of the base 4 by a metal bond matrix 6.

A manufacturing method for the metal-bonded grinding tool 2 according to the first preferred embodiment will now be described. In the following description, wt % will be referred to simply as %, and other % such as atm % will be expressed as they are. 66% of bronze powder containing 23% of Sn, 11% of Ti compound powder, and 20% of stearic acid as the organic viscous material are kneaded by a kneader with good stirring to obtain a paste mixture.

This paste mixture is applied to the outer circumferential portion of the base 4 by using a spatula or the like. It is preferable to remove an extra amount of the applied paste mixture with a thickness gauge jig and thereby adjust the thickness of the applied paste fixture to a given uniform thickness, in order to obtain a target thickness of the metal bond matrix 6. Thereafter, a required amount of diamond abrasive grains 8 is scattered to be deposited on the paste mixture. Then, the grinding tool is put into a vacuum furnace, and the acuum furnace is evacuated down to a vacuum of 3.9 Pa.

In this condition, the grinding tool is maintained at 950° C. for 20 minutes in the vacuum furnace. Thereafter, the grinding tool is removed from the vacuum furnace and cooled to normal temperature or room temperature.

By maintaining the grinding tool at 950° C. for 20 minutes in the vacuum furnace, the paste mixture is melted. The melted paste mixture is cooled to normal temperature and thereby solidified to be bonded to the base 4. Ti has a property of exerting a reducing power to wet the diamond abrasive grains 8, and is well soluble in bronze. Accordingly, the diamond abrasive grains 8 are chemically strongly fixed to the metal bond matrix 6, thereby preventing the separation of the diamond abrasive grains 8 from the metal bond matrix 6.

Figure 3:
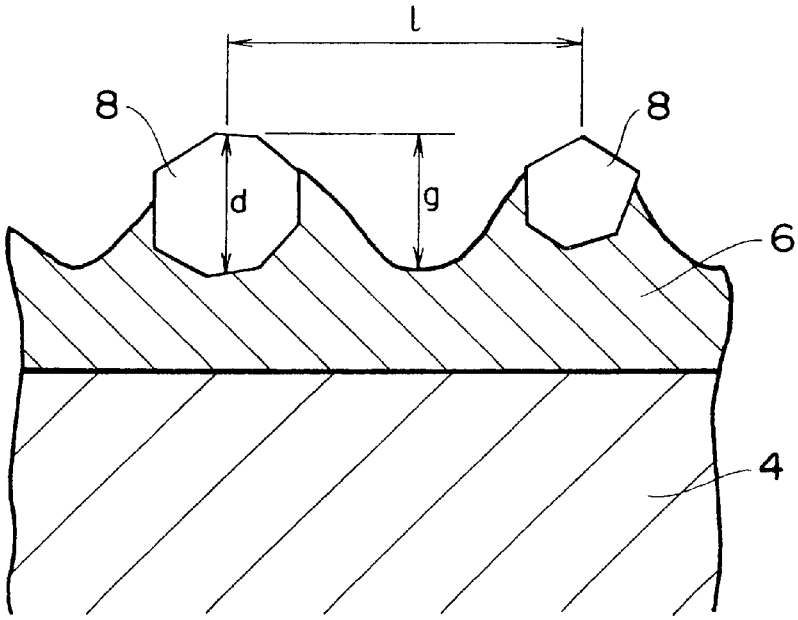
FIG. 3 is an enlarged view of an essential part of the grinding tool shown in FIG. 2.

As shown in FIG. 3 which is an enlarged view of an essential part of :the grinding tool shown in FIG. 2, the diamond abrasive grains 8 project from the metal bond matrix 6, and the distance from the surface of a deepest portion of the metal bond matrix 6 between any adjacent ones of the diamond abrasive grains 8 to the peak of any one of the diamond abrasive grains 8 will be referred to as a grain protrusion. It is preferable to set an average grain protrusion g to 30% or more of an average grain diameter d. It is also preferable to set an average grain spacing l to 200% or more of the average grain diameter d. Thus, the average grain protrusion g of the diamond abrasive grains 8 is set larger than that of the conventional grinding tool, and the average grain spacing 1 is also set large, thereby exhibiting an excellent grinding performance and/or cutting performance.

The average grain protrusion g can be adjusted by controlling the thickness of the paste mixture applied to the base 4. In general, the thickness of the paste mixture applied to the base 4 is preferably set to 70 to 120% of the average grain diameter d. The average grain protrusion g is obtained by the following method. Any arbitrary three areas on the grinding tool 2 where the diamond abrasive grains 8 are present are first selected, and the grain protrusions of ten diamond abrasive grains 8 in each area are measured. That is, the grain protrusions of totally thirty diamond abrasive grains 8 are measured. Thereafter, an arithmetic mean of these measured grain protrusions is calculated as the average grain protrusion g. The measurement of the grain protrusions is made by using a microscope.

The grain size of the diamond abrasive grains 8 is preferably set to 20 to 80 mesh in the case of use for cutting, or to 80 to 400 mesh in the case of use for grinding. The abrasive grains are not limited to diamond abrasive grains, but any one of CBN (cubic boron nitride), silicon carbide, demented carbides powder may be adopted as the abrasive grains. The copper alloy as the main component of the metal bond matrix 6 is selected from bronze containing 10 to 33% of Sn, brass containing 5 to 20% of Zn, and aluminum bronze containing 5 to 20% of Al. Particularly in the case of using the aluminum bronze, the abrasive grains can be bonded to the metal bond matrix without mixing the Ti compound powder provided that the degree of vacuum is increased in heating the paste mixture. Alternatively, the abrasive grains can be bonded to the metal bond matrix with a small content of the Ti compound powder even in the case that the degree of vacuum in heating the paste mixture is low.

The Ti compound powder used in the first preferred embodiment is Ti compound powder containing 50 atm % of Al—Ti (about 36 wt % of Al). The content of Ti in the Ti compound powder is preferably set to about 10 to 15% with respect to the whole of the metal bond matrix 6. The particle size of the Ti compound powder is preferably set to about 240 to 350 mesh. The Ti compound powder may be replaced by Ti powder, Al powder, or Al compound powder. Ti or Al has a property of exerting a reducing power to wet ceramic abrasive grains, and is well soluble in copper alloy. Further, Ti or Al serves also as a suitable additive for the metal bond matrix 6, because of its function of enhancing the strength of the copper alloy. Examples of the organic viscous material include stearic acid, paraffin, polyethylene glycol, or a mixture thereof.

Figure 4:
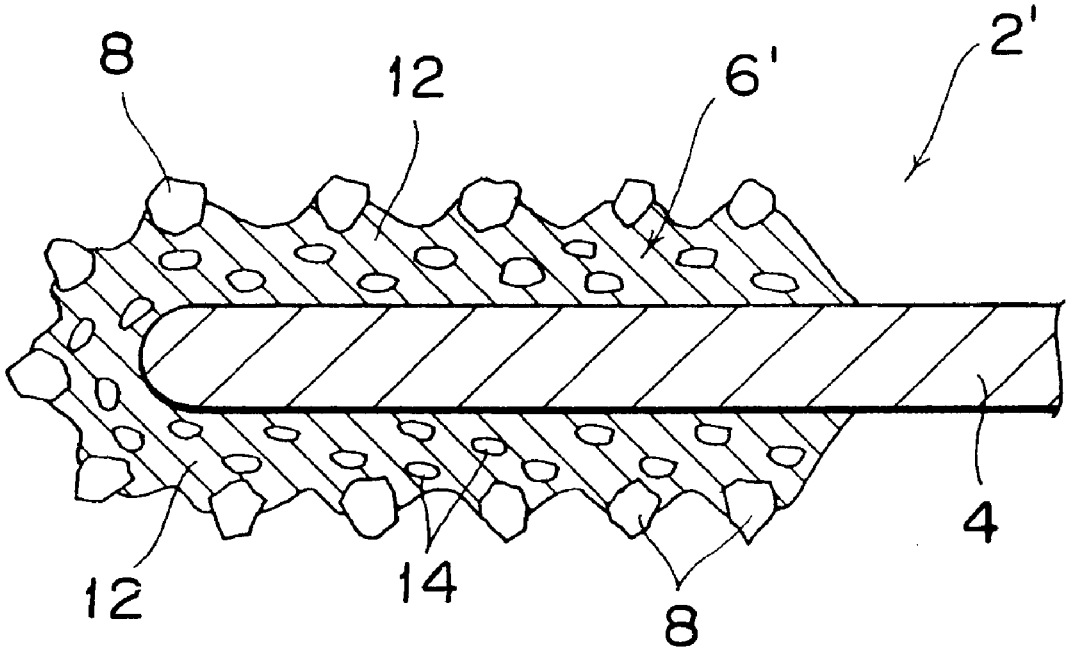
FIG. 4 is a view similar to FIG. 2, showing a second preferred embodiment of the present invention.

FIG. 4 is a sectional view similar to FIG. 2, showing a grinding tool 2' according to a second preferred embodiment of the present invention. The grinding tool 2' employs two kinds of copper alloys 12 and 14 having the same main ingredient as a metal bond matrix 6'. More specifically, bronze containing 33% of Sn is adopted as the copper alloy 12 having a low melting point, and bronze containing 23% of Sn is adopted as the copper alloy 14 having a high melting point.

A manufacturing method for the grinding tool 2' according to the second preferred embodiment will now be described. 32% of bronze powder containing 23% of Sn, 32% of bronze powder containing 33% of Sn, 16% of Ti compound powder, and 20% of paraffin as the organic viscous material are kneaded by a kneader with good stirring to obtain a paste mixture. This paste mixture is applied to the outer circumferential portion of the base 4 by using a spatula or the like. It is preferable to remove an extra amount of the applied paste mixture with a thickness gauge jig and thereby adjust the thickness of the applied paste mixture to a given uniform thickness, in order to obtain a target thickness of the metal bond matrix 6'.

Thereafter, a required amount of diamond abrasive grains 8 is scattered to be deposited on the paste mixture. Then, in order not to melt the high-melting-point copper alloy 14 but to melt only the low-melting-point copper alloy 12, the grinding tool is heated at 870' C. for 10 minutes in a vacuum furnace evacuated to 3.9 Pa. Thereafter, the grinding tool is removed from the vacuum furnace and cooled to normal temperature or room temperature. Accordingly, the melted low-melting-point copper alloy 12 is solidified to be bonded to the base 4, and the diamond abrasive grains 8 are fixed by the metal bond matrix 6' as shown in FIG. 4.

In this preferred embodiment, a setting height (distance between the base 4 and the peak of each abrasive grain 8) in the case of use for cutting can be freely set by adjusting the content of the high-melting-point copper alloy. The difference in melting point between the high-melting-point copper alloy and the low-melting-point copper alloy is preferably set to at least 50° C., and about 150° C. at the maximum.

Example 1

A cutting test tool having a diameter of 10 inches (254 mm) was fabricated by using the manufacturing method according to the first preferred embodiment. This test tool has dimensions such that the base 4 has a thickness of 2.0 mm, the cutting edge has a thickness of 3.0 mm, and the mounting hole 10 has a diameter of 25.4 mm. By using this test tool, a glass fiber reinforced plastic (GFRP) plate having a thickness of 15 mm was cut for evaluation. In this test tool, the grain size of the diamond abrasive grains 8 was set to 50–60 mesh, the average grain diameter d was set to 0.274 mm, and the average grain spacing l was set to 0.88 mm. This test tool was mounted on a running saw type machine.

The average grain protrusion g of the diamond abrasive grains 8 was changed by changing the thickness of the metal bond matrix 6, and the load on the spindle on which the test tool was mounted was measured as a cutting resistance. The peripheral speed of the test tool was set to 48 m/s, and the feed speed was set to 83 mm/s. In a conventional impregnated sintered tool having a ratio g/d of 0.15, the cutting resistance per unit area of the outer circumferential portion of the tool was 170 watts/cm$^2$. In a conventional electroplated tool having a ratio g/d of 0.18, the cutting resistance was 156 watts/cm$^2$.

Figure 5:
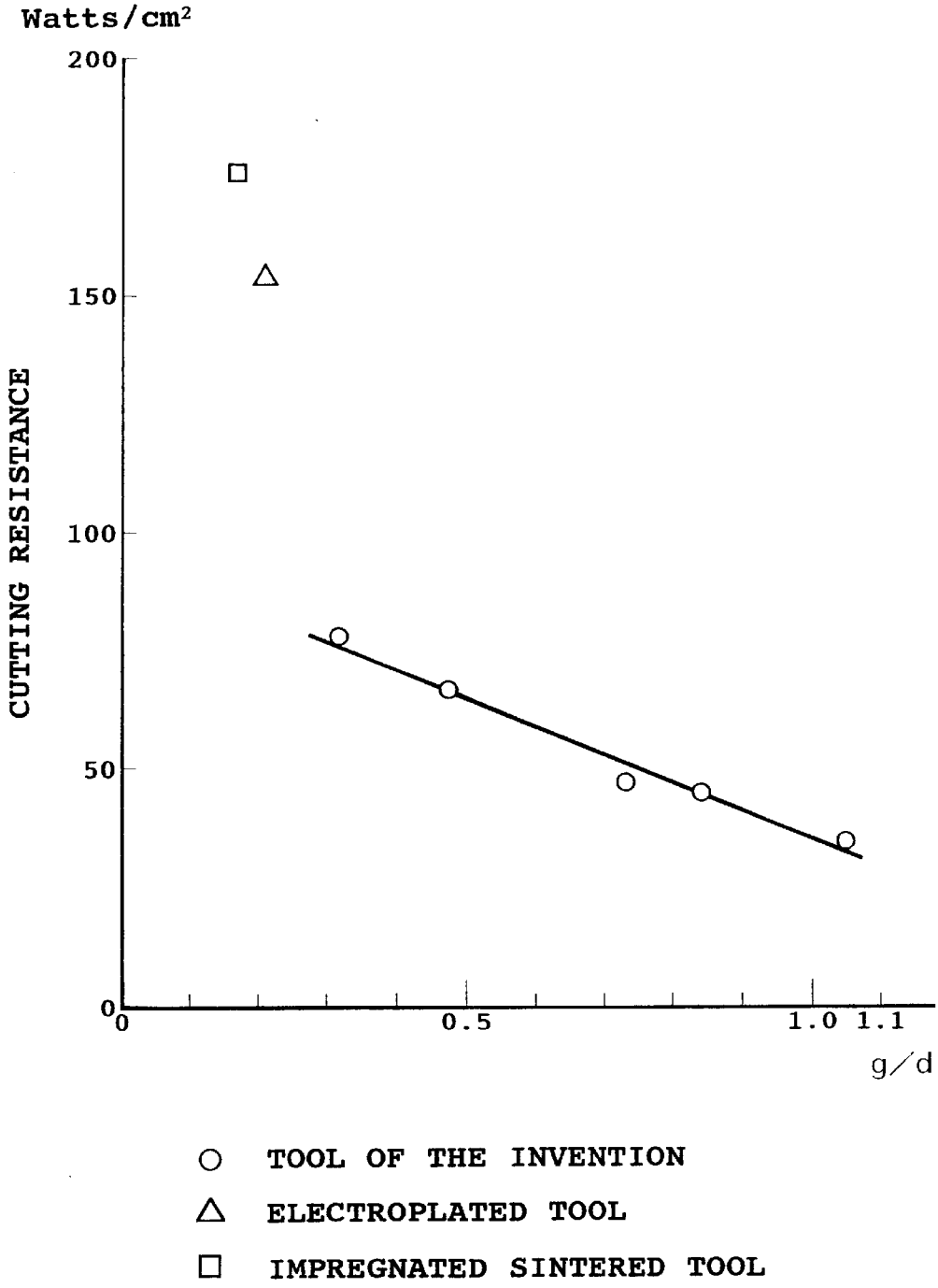
FIG. 5 is a graph showing a cutting resistance of the tool according to the present invention in the case of changing the ratio g/d and also showing cutting resistances of conventional different types of tools as comparisons.

In contrast thereto, the ratio g/d in the first preferred embodiment was set to 0.31 to 1.05. By setting the ratio g/d in this range, the cutting resistance was 79 to 36 watts/cm$^2$. Thus, it was confirmed that the GFRP plate could be cut under low loads. The test results are shown in FIG. 5. While the grain size of the diamond abrasive grains 8 was set to 50–60 mesh in this test, a similar tendency was confirmed also in diamond abrasive grains having other mesh sizes, such as 40–50 mesh, 60–80 mesh, and 80–100 mesh.

Further, another test tool having the same shape as that of Example 1 was fabricated under the conditions that the ratio g/d was fixed to about 0.7 and that the distribution of the diamond abrasive grains, or l/d, was changed between 1.5 and 30. Then, a test similar to that of Example 1 was made by using this test tool and the conventional electroplated tool (g/d=0.18, l/d=1.2) as comparison. The test results shown that the smaller the ratio l/d, the larger the rate of increase in the cutting resistance when cutting a fixed amount, so that the rate of increase in the cutting resistance was maximum in the electroplated tool. It was cleared that the cutting resistance was small in the range of 2.0 to 10 for l/d, thereby extending the life of the tool. Of this range, l/d=3 to 7 is preferable, because the cutting resistance is small and the life of the tool can be extended.

In the tool having a ratio l/d of 3, the proportion of the surface area of the diamond abrasive grains to the surface area of the metal bond matrix is about 25%. In the tool having a ratio l/d of 7, this proportion is about 5%. In the tool having a ratio l/d of 2.0, this proportion is about 60%. There are variations in the measured value of the average grain spacing l in each tool, so it can be said that the average proportion of the surface area of the diamond abrasive grains to the surface area of the metal bond matrix is preferably not greater than 60%.

Example 2

Figure 6:
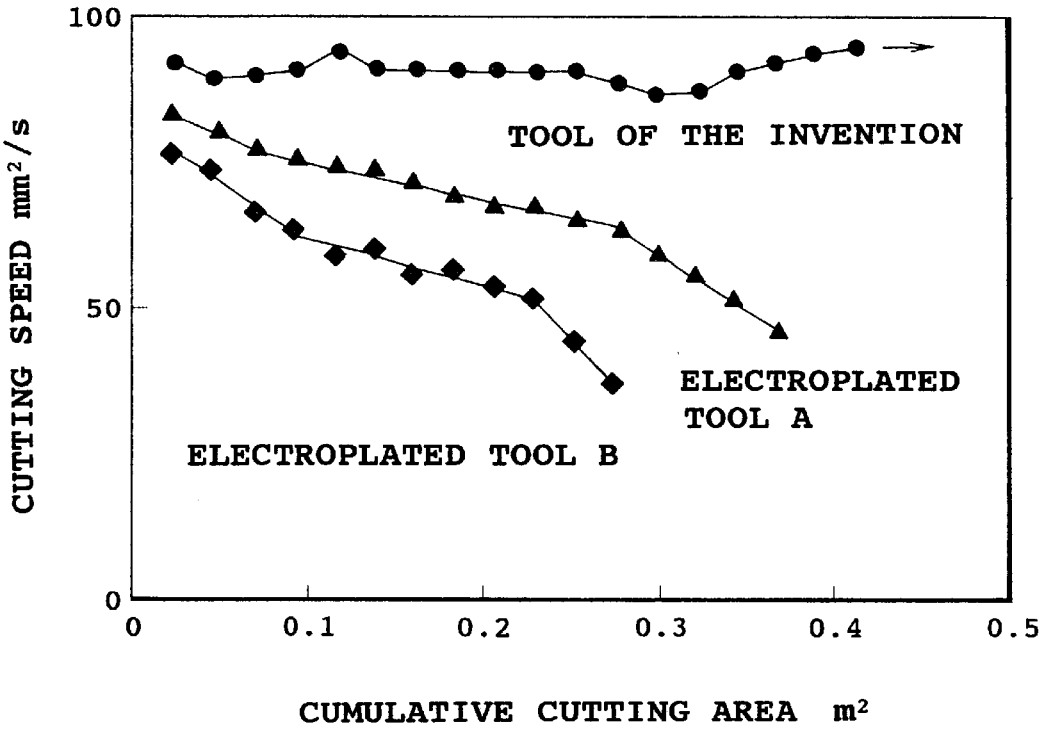
FIG. 6 is a graph showing the relation between a cumulative cutting area and a cutting speed of the tool according to the present invention as compared with conventional electroplated tools.

A cutting test tool having a diameter of 12 inches (30.48 cm) was fabricated by using the manufacturing method according to the second preferred embodiment. This test tool was mounted on a hand-held engine cutter to cut a ductile cast iron pipe having a diameter of 350 mm. A cutting speed was measured on the tool according to the present invention and on conventional electroplated tools A and B as comparisons. Diamond abrasive grains were used in each tool, and the grain size was set to 40–50 mesh in each tool. The test results are shown in FIG. 6.

It was determined that the life of each of the conventional electroplated tools A and B was ended at the time the cutting speed was decreased to the half of an initial cutting speed. To the contrary, the cutting performance of the tool according to the present invention was hardly lowered even after cutting a cumulative cutting area of 0.5 m$^2$ or more.

According to the grinding tool of the present invention, the abrasive grains are chemically strongly fixed to the metal bond matrix, so that the separation of the abrasive grains from the metal bond matrix can be prevented and a long-term, stable grinding performance can be maintained. Because the abrasive grains are not separated, the abrasive grains can be effectively used, thereby providing a low-cost grinding tool. Furthermore, the amount of projection of each abrasive grain can be made very large, so that the removability of the chips of a workpiece can be improved. Further, since the metal bond does not come into contact with the workpiece, the grinding resistance can be reduced. As a result, a high grinding performance can be exhibited, and good dissipation of grinding heat can be ensured.

According to the manufacturing method of the present invention, the abrasive grains are scattered on the paste mixture, so that the grain spacing can be freely adjusted. As a result, the present invention can be applied to a wide variety of work ranging from a hard material such as stone to a soft material that is prone to cause loading or clogging, such as wood cement board or FRP containing iron. In particular, the present invention can exhibit a profound effect to grinding and/or cutting of a composite material of hard brittle material+soft material, such as a cemented tile and wood board.

What is claimed is:

1. A manufacturing method for a metal-bonded grinding tool, comprising the steps of:

kneading (A) a Cu alloy powder selected from the group consisting of bronze containing 10 to 33 wt % of Sn, brass containing 5 to 20 wt % of Zn, and aluminum bronze containing 5 to 20 wt % of Al, (B) a powder selected from the group consisting of Ti, Ti compound, Al, Al compound, and a mixture thereof, and (C) an organic viscous material to obtain a paste mixture, wherein said organic viscous material is selected from the group consisting of stearic acid, paraffin, and polyethylene glycol;

applying said paste mixture to a base;

depositing abrasive grains to said paste mixture;

heating said paste mixture in a high vacuum of 20 Pa or less to melt at least a part of said paste mixture; and cooling said paste mixture at least until said melted part is solidified, thereby chemically bonding said abrasive grains to said base.

2. A manufacturing method for a metal-bonded grinding tool, comprising the steps of:

kneading (A) a Cu alloy powder selected from the group consisting of bronze containing 10 to 33 wt % of Sn, brass containing 5 to 20 wt % of Zn, and aluminum bronze containing 5 to 20 wt % of Al, and wherein said Cu alloy powder is composed of a high-melting-point alloy powder and a low-melting-point alloy powder, (B) a powder selected from the group consisting of Ti, Ti compound, Al, Al compound, and a mixture thereof, and (C) an organic viscous material to obtain a paste mixture;

applying said paste mixture to a base;

depositing abrasive grains to said paste mixture;

heating said paste mixture in a high vacuum of 20 Pa or less to melt at least a part of said paste mixture; and cooling said paste mixture at least until said melted part is solidified, thereby chemically bonding said abrasive grains to said base.

* * * * *